United States Patent [19]

Carrieri

[11] 4,272,980

[45] Jun. 16, 1981

[54] LOAD EQUALIZER FOR PRESS TOOLING

[75] Inventor: Louis F. Carrieri, LaGrange Park, Ill.

[73] Assignee: Gulf & Western Manufacturing Company, Southfield, Mich.

[21] Appl. No.: 65,562

[22] Filed: Aug. 10, 1979

[51] Int. Cl.[3] ..... B21J 13/02

[52] U.S. Cl. ..... 72/404; 72/432; 72/473

[58] Field of Search ..... 72/404, 413, 473, 432, 72/441, 465; 100/295, 237

[56] References Cited

U.S. PATENT DOCUMENTS

| | | | |
|---|---|---|---|
| 364,948 | 6/1887 | Moore | 100/237 |
| 1,937,908 | 12/1933 | O'Brien | 72/465 |
| 3,201,811 | 8/1965 | Marasco | 100/237 |
| 3,635,060 | 1/1972 | Hozoji | 72/20 |
| 3,747,194 | 7/1973 | Christensen | 72/465 |
| 4,053,276 | 10/1977 | Ahrweiler | 100/295 |

*Primary Examiner*—Lowell A. Larson
*Assistant Examiner*—Gene P. Crosby

[57] ABSTRACT

A pair of press tools, such as punches, are mounted on a tool support for axial reciprocation between extended and retracted positions with respect to the support. The tool support may be defined by a press slide, bed or component part of a tooling package mountable thereon and is provided with a hydraulic fluid receiving cylinder for each of the tools. Each tool is interconnected with a piston received in the corresponding cylinder and the cylinders are in flow communication with one another. Accordingly, if one of the tools engages a workpiece before the other during operation of the press, the one tool is displaced in the direction of retraction causing the other tool to be displaced in the direction of extension until both tools engage the workpiece, thus to avoid eccentric loading of the press slide and frame. Both tools have a neutral position with respect to their extended and retracted positions and, upon movement of the press slide away from the work, a biasing arrangement returns the extended one of the tools to its neutral position and the displacement of the corresponding piston causes the retracted tool to be returned to its neutral position.

20 Claims, 5 Drawing Figures

LOAD EQUALIZER FOR PRESS TOOLING

BACKGROUND OF THE INVENTION

This invention relates to the art of press tooling and, more particularly, to a load equalizing arrangement for plural press tools.

It is often desirable to provide a single press with plural sets of opposed tools to enable a number of pressing operations to be achieved simultaneously during each working stroke of the press. Such tool sets may, for example, be defined by opposed sheet metal shaping dies, opposed punch and die components, and the like, and the plural pressing operations performed thereby may either be like or different with respect to the work performed by the tooling. In any event, a difference in workpiece thickness from that for which the tools are adjusted results in undesirable eccentric loading of the press slide and frame upon engagement of the tooling with the workpieces. This is especially true where the press slide is of the single point drive type in which the driving force is through a single axis centrally of the slide and the press tools are laterally spaced from the slide axis. In this respect, if one tool pair engages a workpiece therebetween before the other tool pair, the working force is transmitted axially of the first tool pair while the other tool pair is unloaded. Thus, the slide is eccentrically loaded due to the spacing of the tooling from the slide axis, and this load is transmitted by the slide to the press frame resulting in severe wear of the slide guides and possibly failure of the guides and press frame. Moreover, such wear of the slide guides leads to inaccuracy with respect to lateral positioning of the slide and thus inaccuracy with respect to cooperative interengagement between the opposed tool components. These problems often make it impractical to perform plural press operations simultaneously in a single point mechanical or hydraulic press.

Such eccentric loading can be avoided by mounting multiple tools on the press for axial displacement relative to one another, such as shown in U.S. Pat. No. 1,937,908 to O'Brien, so that a working force is not applied until all of the tools engage corresponding workpiece portions. Such relative tool displacement alone, however, introduces undesirable limitations on the use of a press for performing sequential working operations on a given workpiece at multiple working stations of a press and/or performing different working operations on a given workpiece at a single working station of a press. In this respect, once the tools are relatively positioned during engagement thereof with a workpiece, such positioning is maintained during the subsequent return and work stroke of the press. In a press wherein a workpiece is advanced step-by-step to sequential tooling stations for the sequential performance of different work thereon, such initial tool positioning can result in interference between the workpiece and tooling during workpiece transfer and/or between the tooling and the workpiece feed mechanism during the workpiece transfer, thus subjecting the tooling, workpiece and transfer mechanism to potential damage. While these problems might be avoided in connection with a press having a slide stroke sufficiently long to assure necessary workpiece-tool and tool-feed mechanism clearances, it will be appreciated that such a requirement not only limits use of the tooling arrangement to certain presses but additionally results in inefficient press operation and limits the versatility of both the tooling and presses with which the tooling might otherwise be used.

Further in the foregoing respect, it is often desired to provide a press with a plurality of work stations each capable of performing the same working operation on a given workpiece using alternately available like tools on one of the press slide and bed members, or sequentially performing different tooling operations by alternately available different tools on the press member. More particularly, in hot forming a plurality of workpieces at different work stations of a press, shuttle mechanisms are often provided for sequentially presenting cooled tooling on successive strokes of the slide to enable the tooling just used to cool or be cooled. This enables operating the press at an efficient stroke rate. Similarly, tool shuttles are often provided to sequentially position functionally different tooling at a given work station during succeeding slide strokes for different working operations to be performed on a given workpiece at the work station. Often, such shuttling mechanisms require predetermined positioning of tools relative thereto to enable operation of the shuttle. Thus, relative load equalizing positioning of tooling during one stroke of such a press tooling arrangement, without more, could cause inoperability of the shuttle mechanism. Even if such inoperability is not a problem, it remains that such relative positioning can result in tool-workpiece and/or tool-feed mechanism interference and/or damage which as mentioned above can be avoided only by limiting use of such tooling to a press having sufficient stroke length to assure clearances to avoid such interference.

SUMMARY OF THE INVENTION

In accordance with the present invention, a load equalizing arrangement for press tooling is provided which advantageously avoids the foregoing problems and, thus, minimizes potential damage to workpieces and tooling and optimizes versatility with respect to the tooling operations which can be performed in a given press as well as the versatility of a press having a given stroke in connection with providing the same with a load equalizing tooling arrangement. More particularly in accordance with the present invention, two or more tools are supported on a press and hydraulically interconnected for retraction of one of the tools upon engagement with a corresponding workpiece to cause extension of the other tool toward its corresponding workpiece so that a working force is not applied until both tools engage their corresponding workpieces. The multiple tools have a neutral position with respect to their extended and retracted positions and, upon movement of the tools away from the workpieces, the extended one of the tools is biased to its neutral position and the hydraulic interconnection between the tools displaces the retracted one of the tools to its neutral position. Accordingly, clearances necessary to achieve workpiece feed between tooling stations without workpiece-tool and/or tool-feed device interference can be minimized in that the tools are repositioned after a work stroke in accordance with such clearance requirements. Additionally, such repositioning capability enables the use of tooling having different axial positions relative to one another during a work stroke to be employed at different work stations of the same press without requiring a press stroke sufficient to displace the axially extended most of the two tools away from its mating tool during return stroke of the press to assure clearance for workpiece feed between the work stations. In this respect, by returning the extended tool to a neutral position, a shorter slide stroke is required to achieve the necessary clearance.

Still further, in those situations wherein unbalanced loading on the press having plural tooling results from a difference in material thickness in workpieces being operated on by similar tooling at plural work stations, such variation in thickness may occur during one work stroke and not the subsequent work stroke, or the variation in thickness may be reversed between the tooling on successive work strokes. In either case, the load equalizing arrangement is required to readjust either to the normal tooling position in the first instance or the opposite tooling displacement relationship in the second instance. Such return or reverse displacement of the tooling, if achieved in response to tool-workpiece engagement, imposes considerable stress on the load equalizing hydraulic system in the form of high fluid pressure and high velocity fluid transfer. By returning the tooling to a neutral position by an internal biasing arrangement in accordance with the present invention, such stress on the hydraulic system is advantageously minimized, thus reducing wear and maintenance and/or replacement operations. In this respect, if the workpieces during a succeeding stroke of the press do not have a variation in thickness, the return of the tooling to neutral positions by an internal biasing arrangement advantageously avoids any pressure and high velocity flow in the hydraulic system on the succeeding press stroke. Further in this respect, if reversal of tool displacement is required because the variation in workpiece thickness is reversed on succeeding press strokes, return of the tooling to a neutral position between working strokes reduces the extent of tool displacement required by engagement of one of the tools with a workpiece and, thus, the period of stress imposed by hydraulic flow through the tooling system to achieve such displacement. Still further, as mentioned hereinabove, the use of shuttle mechanisms for alternate positioning of tools at a work station often requires specific positioning of the tools following the work stroke of the press to enable shuttling displacement, and return of tooling to a neutral position in accordance with the present invention advantageously enables achieving such specific positioning and, thus, the use of load balancing tooling arrangements in connection with such tool shuttle arrangements.

A primary object of the present invention is to provide an improved hydraulically operated load equalizing system for multiple tooling for a press.

A further object is the provision of a load equalizing system of the foregoing character having considerable versatility with respect to tooling operations which can be performed in a given press at multiple work stations thereof and with respect to presses and press tooling support arrangements with which the load equalizing system can be employed.

Still a further object is the provision of a load equalizing system of the foregoing character in which the tooling is self-adjusting to neutral tool positions between work strokes of a press so as to minimize the effects of hydraulic pressure and flow velocity on the system and component parts thereof during operation of the system to achieve load equalization during a working stroke of the press.

Another object of the invention is to provide a hydraulically operated load equalizing system of the foregoing character which is economical to construct, operate and maintain, and which is efficient in operation.

BRIEF DESCRIPTION OF THE DRAWINGS

The invention may take physical form in a variety of parts and arrangements of parts, preferred enbodiments of which will be described in the following specification and which are illustrated in the accompanying drawings which form a part hereof and wherein.

DESCRIPTION OF THE PREFERRED EMBODIMENTS

Figure 1:
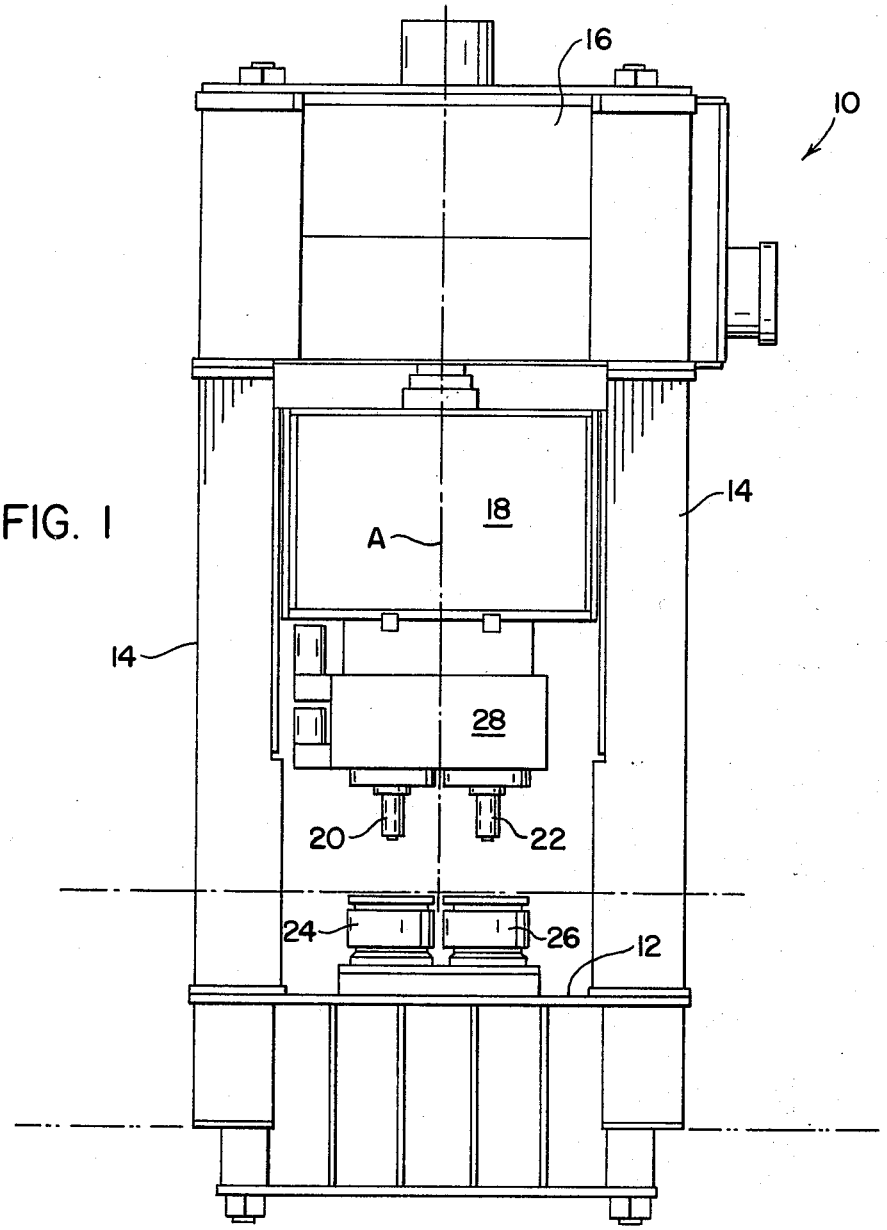
FIG. 1 is a front elevation view of a conventional press including an arrangement of plural work stations each having opposed tools between the slide and bed of the press.

Referring now to the drawings wherein the showings are for the purposes of illustrating preferred embodiments of the invention only and not for the purpose of limiting the invention, FIG. 1 of the drawing illustrates a multiple station metalworking press, indicated generally by reference numeral 10, comprised of a frame including a bed 12, upright frame members 14 and a top portion 16. In a well known manner, a press slide 18 is supported by the frame for reciprocating movement vertically through a slide stroke, from top dead center toward bottom dead center and in a direction toward bed 12, the distance between top and bottom dead center positions defining the length of the slide stroke. Slide 18 can be mechanically or hydraulically driven and the components of such a drive train and the interrelationships therebetween are well known to those skilled in the art and are not important to the understanding of the present invention, accordingly these details are not shown and described herein.

Slide 18 and bed 12 support a plurality of punches and corresponding die assemblies, respectively, which operate during each stroke of the slide to perform a metalworking operation on a workpiece disposed therebetween. In the embodiment shown, the tool pairs include punches 20 and 22 mounted on slide 18 and corresponding die assemblies 24 and 26 mounted on bed 12 beneath and in alignment with punches 20 and 22, respectively. The punches and dies may provide like pairs of tools for performing the same work on workpieces therebetween, or may provide functionally different tool pairs for sequentially performing different work on a given workpiece positioned between one pair and then the other on successive strokes of the press. For purposes of the following description it will be assumed that the punches and dies provide like pairs of tools for working like workpieces having a design thickness in the direction of tool displacement. Thus, as slide 18 moves toward bed 12, workpieces are engaged between punches 20 and 22 and the corresponding die and are shaped or otherwise worked by the tooling.

In the event that the actual thickness of one workpiece varies from the design thickness, the one of the punches 20 and 22 associated with the thicker workpiece will engage the workpiece prior to the other punch engaging its workpiece. It will be appreciated with the aid of FIG. 1 that the one punch then imposes a force on the slide opposite to the force of the moving slide and laterally offset from the slide axis A through which the slide force is transmitted. Such unbalanced force is transmitted through the slide to the frame members. For example, if punch 20 first engaged a workpiece associated therewith, a force would be exerted against left upright frame member 14 at the lower left corner of slide 18, as viewed in FIG. 1. Simultaneously, an equal force would be exerted against right upright frame member 14 at the upper right corner of slide 18. It will be appreciated too that the mechanical or hydraulic drive mechanism for reciprocating the slide is adversely affected by such unequal application of force on the slide.

In accordance with the present invention, such unbalanced application of forces on the slide, frame and driving mechanism is minimized by mounting the tools for relative displacement so that force is not imposed therethrough to the slide until all the tools engage the workpiece or workpieces. Furthermore, the invention advantageously provides for return of the tools to a neutral position following the working operation, whereby special mounting arrangements and/or slide and bed modifications are not required with respect to a given press to enable use of the load equalizing mechanism. In the embodiment of the invention shown in FIGS. 2 and 3 of the drawing, punches 20 and 22 are mounted on a common support member 28 adapted to be attached to slide 18 for displacement therewith. Punches 20 and 22 are each integral with or suitably mounted on a corresponding cylindrical piston rod 30 having a primary piston 32 integral with or suitably secured to the upper end thereof. Tool support 28 is provided with a pair of primary cylinders 34 each slidably receiving one of the primary pistons 32, and each primary piston 32 is provided with a sealing ring 36. Primary cylinders 34 are interconnected by a fluid passage 38 in tool support 28 which opens into the upper end of each primary cylinder 34. Passage 38 has an entrance portion 40 connected to a high pressure responsive accumulator 42 and to a hydraulic fluid supply circuit which functions as set forth below.

Figure 2:
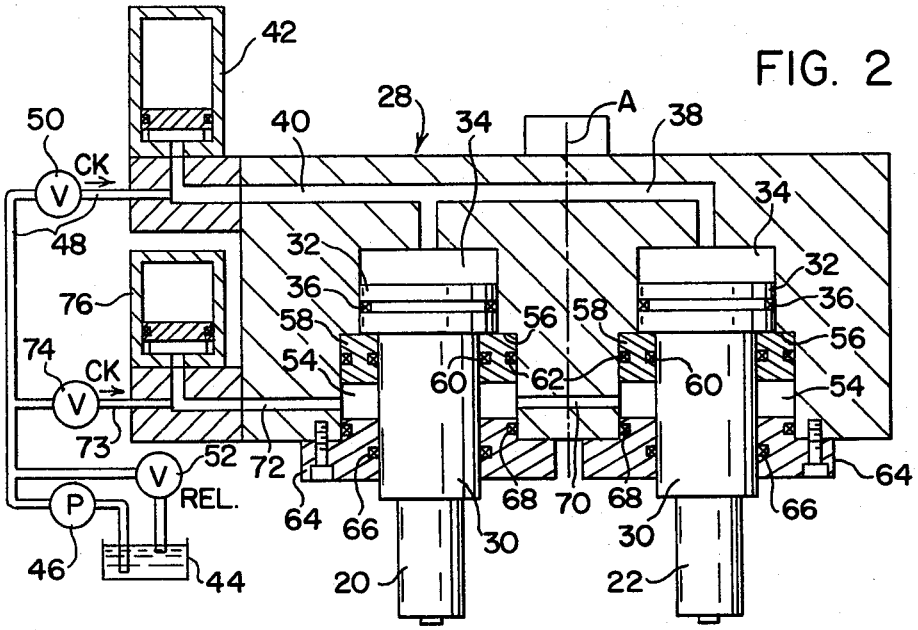
FIG. 2 is a sectional elevation view of the upper tool support for the tooling shown in FIG. 1 and illustrating a hydraulic load equalizing arrangement therefor constructed in accordance with the present invention.

The hydraulic fluid supply circuit includes a hydraulic fluid source 44 and a motor driven pump 46 for delivering fluid under pressure from source 44 to entrance 40 of passage 38 through flow line 48. A check valve 50 in line 48 prevents backflow of fluid in the supply circuit, and a relief valve 52 provides for return flow of fluid to source 44 when system pressure is reached. Fluid delivered to passage 38 and primary cylinders 34, at a predetermined pressure, causes primary pistons 32 to position punches 20 and 22 as shown in FIG. 2. Accumulator 42 operates in a well known manner to provide high pressure overload protection for the press and press tooling by limiting the maximum force which may be imposed on the punches during a working operation. When such force is exceeded, accumulator 42 operates to allow the tools to retract relative to support 28. It will be appreciated of course that such overload protection is separate from the tool load equalizing to be described below.

Figure 3:
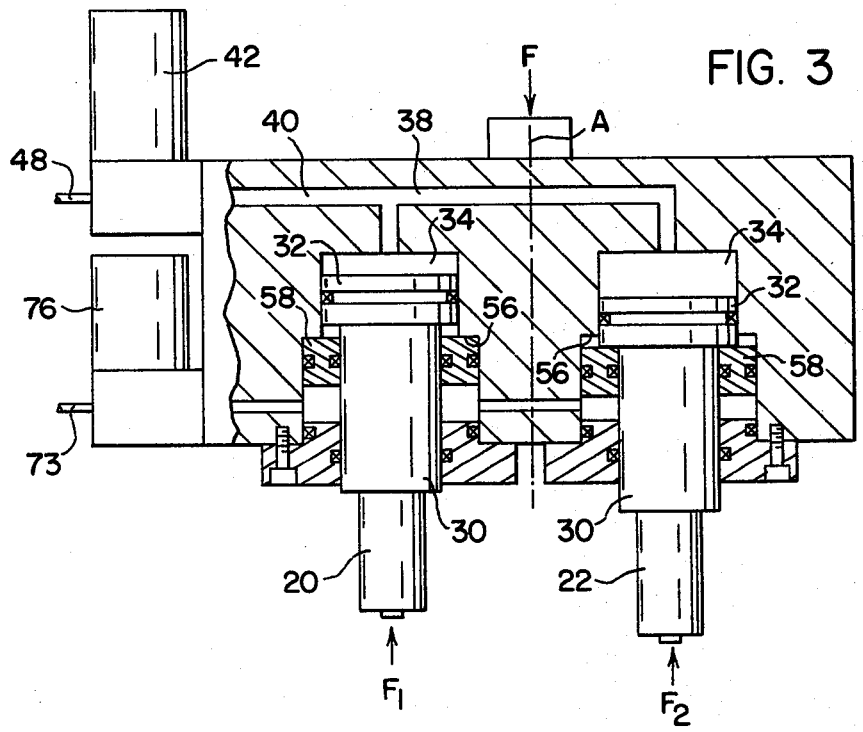
FIG. 3 is a view similar to FIG. 2 and illustrating the press tool positions during engagement of the tools with a workpiece or workpieces.

Equalization of load forces against punches 20 and 22 occurs when one of the punches engages a workpiece associated therewith prior to the other punch engaging its workpiece. Such a situation occurs for example when the thickness of the workpieces varies unintentionally. FIG. 2 illustrates the hydraulic load equalizing system prior to engagement of a workpiece by either punch. In the event that punch 20 for example engages the workpiece prior to punch 22, as depicted in FIG. 3, a force $F_1$ is exerted axially against punch 20 causing its primary piston 32 to retract into its primary cylinder 34, thereby displacing fluid from the cylinder. Since the hydraulic equalizing system is a closed system, with the exception of overload protection as noted above, the hydraulic fluid displaced by the upward movement of punch 20 flows into the primary cylinder 34 of punch 22 causing extension of punch 22 axially from tool support 28. Retraction of punch 20 and extension of punch 22 continues until both punches 20 and 22 engage the corresponding workpiece. At this point in time, punch 22 encounters an upward axial force $F_2$ and the punches perform their intended work on the workpiece as the slide completes its work stroke. It will be noted that such load equalization displacement of the tools is from a neutral position, as shown in FIG. 2, to a position in which one of the tools is extended and the other retracted with respect to the corresponding neutral position.

In accordance with the present invention, the hydraulic load equalizing system provides for the return of the tools from the retracted and extended positions to the neutral position following the work stroke. In the embodiment shown in FIG. 2, this is achieved by a secondary hydraulic piston and cylinder biasing arrangement associated with the tooling. More particularly in this respect, tool support 28 is provided with a pair of secondary cylinders 54 and concentric with and immediately below a corresponding one of the primary cylinders 34. Secondary cylinders 54 are cylindrical and have a greater diameter than primary cylinders 34, whereby a circumferentially extending radial shoulder 56 is provided between each primary and secondary cylinder. Each secondary cylinder slidably receives a secondary piston 58 in the form of a collar slidably receiving the corresponding piston rod 30 and abuting against the underside of the corresponding primary piston 32. Pistons 58 are provided with internal seals 60 and external seals 62 respectively sealingly engaging rods 30 and cylinders 54. Each secondary cylinder 54 is closed at its lower open end by an apertured retaining ring 64 through which the corresponding piston rod 30 extends. Ring 64 is sealed with respect to the rod by a seal 66 and with respect to secondary cylinder 54 by a seal 68. Secondary cylinders 54 are connected by a fluid passage 70 which opens into the lower ends of the secondary cylinders. Hydraulic fluid is introduced into the secondary cylinder by a passage 72 in support member 28 connected to hydraulic supply line 48 through line 73 and check valve 74 which prevents backflow of fluid toward the fluid source. A low pressure responsive accumulator 76 is in flow communication with line 70, and thus secondary cylinders 54, and provides the return bias for the tools as set forth hereinafter.

Referring to the above described relative displacement of the tools during a load equalizing operation, the engagement first of punch 20 with a workpiece causes retraction of the corresponding primary piston 32, and hydraulic fluid communication between primary cylinders 34 causes extension of the primary piston 32 associated with punch 22 and thus extension of the latter punch. During retraction of punch 20 and the corresponding primary piston 32 from the position shown in FIG. 2 to that shown in FIG. 3, the corresponding secondary piston 58 abuts against shoulder 56 whereby retraction of punch 20 is relative to secondary piston 58. The corresponding extension of the primary cylinder 32 of punch 22 by hydraulic fluid flow between the primary cylinders 34 causes the primary piston 32 associated with punch 22 to engage the corresponding secondary piston 58 and displace the latter axially away from the corresponding shoulder 56. The latter displacement forces the hydraulic fluid in the secondary cylinder associated with punch 22 to flow through passage 70 and the secondary cylinder associated with punch 20 and thence through passage 72 and into accumulator 76. This establishes a hydraulic bias which provides for the tools to be returned to the neutral positions shown in FIG. 2 following the working operation and movement of the slide away from the press bed. More particularly, the latter movement of the slide removes the working forces from the punches and the hydraulic fluid in accumulator 76 flows through passages 72 and 70 to bias the secondary piston associated with punch 22 upwardly until the secondary piston engages the corresponding shoulder 56. During such upward movement, the corresponding primary piston 32 forces fluid to flow back into the primary cylinder 34 associated with punch 20, thus to displace the corresponding primary piston 32 and thus punch 20 downwardly in the direction of extension of punch 20, whereby both tools are returned to the neutral positions thereof. It will be appreciated of course that the same basic tool displacement by hydraulic fluid communication between the primary cylinders 34 and the same secondary piston displacement and establishment of a hydraulic return bias would result in response to engagement of punch 22 with a workpiece prior to engagement of punch 20 therewith, whereby punch 22 would be displaced in the direction of retraction as opposed to punch 20 in the operation described above.

Figure 4:
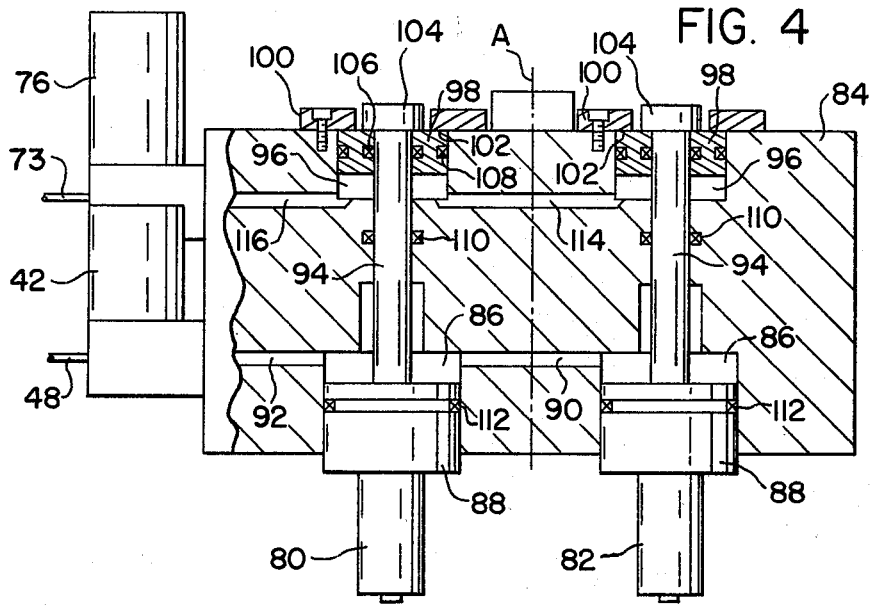
FIG. 4 is a sectional elevation view illustrating another embodiment of a hydraulic load equalizing system for press tooling in accordance with the present invention; and, FIG. 5 is a sectional elevation view illustrating yet another embodiment of a load equalizing system for press tooling in accordance with the present invention.

Another embodiment of the present invention is illustrated in FIG. 4 of the drawing. In this respect, a pair of punches 80 and 82 are mounted on a tool support 84 which, as in the embodiment of FIGS. 2 and 3, is adapted to be supported on a press slide for displacement therewith toward and away from a press bed along a slide axis A. In the embodiment shown in FIG. 4, support member 84 is provided at its lower end with a pair of primary cylinders 86 each slidably receiving a corresponding primary piston 88 to which the corresponding tool is rigidly secured. Cylinders 86 are connected for hydraulic fluid flow therebetween by means of a passage 90 and are adapted to receive hydraulic fluid under pressure from a suitable source through an inlet passage 92 in the support member opening into one of the primary cylinders. The hydraulic circuit for this embodiment may be the same as that for the embodiment shown in FIGS. 2 and 3 and, accordingly, like numerals are employed in FIG. 4 in connection with designating the hydraulic circuit components. Thus, while the entire hydraulic cidrcuit is not shown, it will be appreciated that hydraulic fluid under pressure is delivered from source 44 to primary cylinders 86 through flow line 48 and check valve 50, and that a high pressure overload responsive accumulator 42 is in flow communication with primary cylinders 86 for the purpose described hereinabove in connection with the embodiment of FIGS. 2 and 3.

Each of the primary pistons 88 is provided with a piston rod 94 rigidly secured to and extending upwardly therefrom and through a corresponding secondary hydraulic cylinder 96 at the upper end of support member 84. Each secondary cylinder 96 is coaxial with the corresponding primary cylinder 86 and slidably receives a secondary piston 98 in the form of an apertured sleeve slidably receiving the corresponding piston rod 94. Retaining rings 100 are bolted or other wise secured to the top side of support member 84 to provide circumferentially extending radial shoulders 102 against which the corresponding secondary piston 98 engages. The upper or outer end of each piston rod 94 is provided with a head 104 integral with or suitably secured thereto and engaging the upper or outer side of the corresponding secondary piston 98. Each secondary piston 98 is provided with internal and external seals 106 and 108, respectively sealingly engaging piston rod 94 and secondary cylinder 96. Further, support member 84 is provided with a seal 110 engaging piston rod 94 between the primary and secondary cylinders, and primary piston 88 is provided with a seal 112 sealingly engaging the corresponding primary cylinder. Secondary cylinders 96 are in fluid flow communication with one another by means of a passage 114 therebetween and with the hydraulic system by means of a passage 116 in support member 84. Again, while the hydraulic circuit is not shown, it will be appreciated from FIG. 2 that a check valve in line 73 prevents backflow of fluid toward the fluid source, and the secondary cylinders 96 are in flow communication with a low pressure accumulator 76 which provides a return bias for the tooling following a load equalizing displacement thereof.

With regard to the operation of the embodiment shown in FIG. 4, punches 80 and 82 and thus the primary and secondary pistons are shown in the neutral positions thereof. Assuming punch 80 to be the first to engage a workpiece upon movement of the slide toward the press bed, such engagement displaces punch 80 in the retracting direction, whereby hydraulic fluid flow between primary cylinders 86 through passage 90 causes punch 82 to be displaced in the direction of extension. As with the embodiment of FIGS. 2 and 3, such displacement continues until both punches engage the workpiece or corresponding workpieces. Retraction of punch 80, and thus the corresponding primary piston 88, displaces the corresponding piston rod 94 upwardly relative to the corresponding secondary piston 98 which abuts against shoulder 102 provided by retaining ring 100. Displacement of punch 82 and thus the corresponding primary piston 88 downwardly, however, causes the corresponding secondary piston 98 to be displaced downwardly by head 104 on the corresponding piston rod 94. Such downward displacement of the secondary piston displaces hydraulic fluid from the corresponding secondary cylinder 96 to accumulator 76 to establish the return bias for the tooling. Upon completion of the work stroke and the subsequent return movement of the press slide, the biasing fluid pressure displaces the secondary piston associated with punch 82 upwardly in the corresponding secondary cylinder, whereby punch 82 and the corresponding primary piston 88 are displaced in the direction of retraction through engagement of the secondary piston with head 104 of the piston rod. Such upward displacement of primary piston 88 displaces hydraulic fluid through passage 90 into the primary cylinder associated with punch 80, whereby the latter punch is displaced in the direction of extension through downward displacement of the corresponding primary piston 88. When the return bias of hydraulic fluid from accumulator 76 displaces the secondary piston associated with punch 82 into engagement with shoulder 102 of the corresponding retaining ring 100, the tools are again in the neutral positions thereof.

Figure 5:
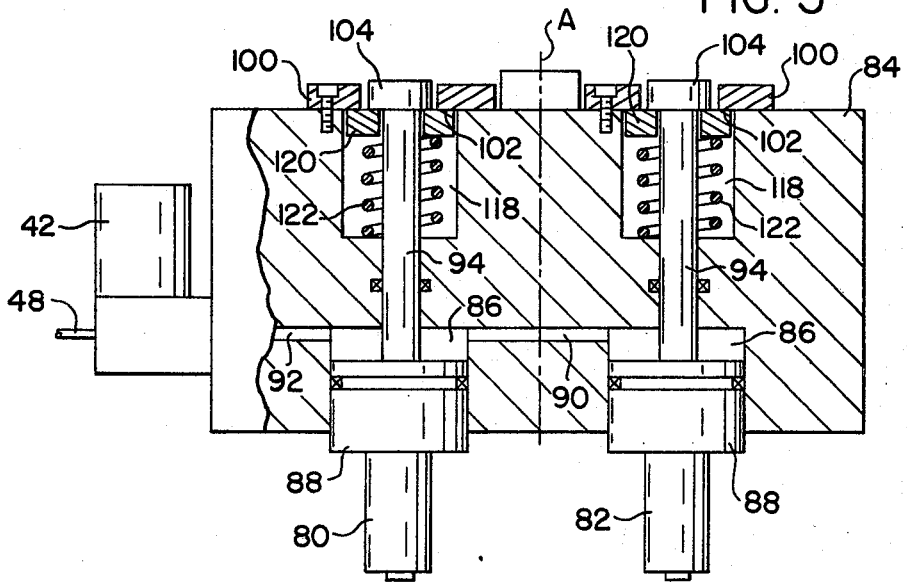

FIG. 5 of the drawing illustrates yet a further embodiment of the invention, structurally similar to the embodiment shown in FIG. 4 but employing a mechanical return bias as opposed to the hydraulic return bias for the tooling. Accordingly, except for the latter arrangement to be described hereinafter, like numerals are employed in FIG. 5 to designate component parts corresponding to the embodiment of FIG. 4. With regard to the return bias arrangement shown in FIG. 5, tool support member 84 is provided with a pair of recesses 118 each coaxial with respect to a corresponding one of the primary cylinders 86. Further, each piston rod 94 is provided with a washer or collar 120 slidably associated therewith for engagement with the corresponding piston rod head 104 and shoulder 102 of retaining ring 100. A compression spring 122 surrounds each piston rod 94 between washer 120 and the inner end of recess 118, thus to bias washer 120 against shoulder 102 of retaining ring 100.

In response to engagement of punch 80 with a workpiece prior to engagement of punch 82 with the same or a corresponding workpiece, punch 80 is displaced in the direction of retraction as described hereinabove in connection with the embodiment of FIG. 4, and punch 82 is displaced in the direction of extension by hydraulic fluid flow between the primary cylinders 86. Retraction of punch 80 displaces the corresponding piston rod 94 upwardly relative to the corresponding washer 120, and the displacement of punch 82 in the direction of extension displaces the corresponding piston rod 94 downwardly, whereby head 104 engages washer 120 to displace the latter downwardly against the bias of the corresponding spring 122. Upon completion of the work stroke and return movement of the press slide away from the press bed, spring 122 associated with punch 82 displaces the latter and thus the corresponding piston 88 in the direction of retraction into the corresponding cylinder 86, whereby punch 80 is displaced in the direction of extension through fluid flow communication between the primary cylinders. Such relative return movement of the tools continues until the spring associated with punch 82 biases washer 120 into engagement with shoulder 102 of the corresponding retaining ring 100. At this time, the tools are again in the neutral positions thereof.

While considerable emphasis has been placed herein on preferred embodiments of the invention and on specific structures and structural interrelationships between the component parts thereof, it will be appreciated that many embodiments of the invention can be made and that many changes can be made in the embodiments disclosed herein without departing from the principals of the invention. In this respect, for example, the press tooling can be mounted directly on a press slide as opposed to a mounting member attached to the slide. Likewise, the tooling can be mounted on the press bed as opposed to the slide and, in connection with either slide or bed mounting, can be incorporated in die components of a unitary tooling assembly. Further, it will be appreciated that the tools can be dissimilar for forming different work functions as opposed to being the same as disclosed herein for the purposes of facilitating the description, and that the neutral positions of the tools need not be the same with respect to the axial positions thereof relative to one another. These and other embodiments of the present invention as well as modifications of the preferred embodiments disclosed will be obvious and suggested to those skilled in the art upon reading the foregoing descriptions. Accordingly, it is to be distinctly understood that the foregoing descriptive matter is to be interpreted merely as illustrative of the present invention and not as a limitation.

Having thus described the invention, it is claimed:

1. In a hydraulic load equalizing system for press tooling comprising first and second tool means, tool support means, means including corresponding piston means and cylinder means supporting each said first and second tool means for reciprocation between extended and retracted positions relative to said tool support means, means connecting said cylinder means in fluid flow communication with one another and with a source of hydraulic fluid, whereby displacement of one of said tool means in the direction from the extented toward the retracted position thereof displaces the other of said tool means in the direction from the retracted toward the extended position thereof, the improvement comprising: said first and second tool means each having a neutral position between the corresponding extended and retracted positions, and means biasing each said tool means in the direction from the extended toward the neutral position thereof.

2. The load equalizing system according to claim 1, wherein said biasing means includes variable volume chamber means and fluid under pressure in said chamber means.

3. The load equalizing system according to claim 1, wherein said biasing means is spring means.

4. The load equalizing system according to claim 1, wherein said biasing means includes secondary piston means and cylinder means for each said tool means and coaxial with the corresponding first named piston means and cylinder means, means interengaging said secondary piston means and corresponding first named piston means for displacement together in the direction from said neutral position toward said extended position, and fluid under pressure in said secondary cylinder means biasing said secondary piston means and corresponding first named piston means in the direction from said extended toward said neutral position.

5. The load equalizing system according to claim 1, wherein said biasing means includes rod means for each piston means, collar means surrounding said rod means, shoulder means interengaging said rod means and collar means for displacement together in the direction from said neutral position toward said extended position and for displacement of said rod means relative to said collar means in the direction from said neutral position toward said retracted position, and means biasing said collar means toward said shoulder means.

6. The load equalizing system according to claim 5, wherein said means biasing said collar means is spring means surrounding said rod means.

7. The load equalizing system according to claim 5, wherein said collar means is a secondary piston, and said means biasing said collar means includes secondary cylinder means receiving said secondary piston and fluid under pressure in said secondary cylinder means.

8. A hydraulic load equalizing arrangement for press tooling comprising, tool support means, means providing first and second hydraulic fluid receiving primary cylinders in said tool support means, said primary cylinders having inner and outer ends with respect to said tool support means, first and second tool means each including a primary piston received in the corresponding one of said first and second primary cylinders, said primary pistons being axially reciprocable in said primary cylinders for displacing the corresponding tool means between extended end retracted positions relative to said tool support means, means providing fluid flow communication between said primary cylinders for displacement of either of said tool means in the direction of retraction thereof to displace the other tool means in the direction of extension thereof, said first and second tool means each having a neutral position between the extended and retracted positions thereof, and means for biasing the primary piston of each said tool means from the extended position to the neutral position of the corresponding tool means.

9. The load equalizing arrangement according to claim 8, and fluid pressure responsive overload relief means in fluid flow communication with said primary cylinders.

10. The load equalizing arrangement according to claim 8, wherein said biasing means includes first and second hydraulic fluid receiving secondary cylinders in said tool support means each coaxial with the corresponding one of said primary cylinders and having inner and outer ends corresponding to said inner and outer ends of said primary cylinders, said first and second tool means each including rod means extending from the corresponding primary piston into the corresponding secondary cylinder, a secondary piston in each secondary cylinder axially slidably surrounding said rod means therein, means providing a first shoulder at the inner end of each secondary cylinder engaged by the corresponding secondary piston in the direction of retraction of the corresponding tool means, means providing a second shoulder on each said rod means engaging the corresponding secondary piston in the direction of extension of the corresponding tool means, and means for directing hydraulic fluid under pressure into each said secondary cylinder to bias the corresponding secondary piston toward said first shoulder.

11. The load equalizing arrangement according to claim 10, wherein said means for directing hydraulic fluid under pressure includes fluid pressure responsive accumulator means in fluid flow communication with said secondary cylinders.

12. The load equalizing arrangement according to claim 10, wherein each said secondary cylinder is axially outwardly adjacent the corresponding primary cylinder and said first shoulder is a radially extending wall between said primary and secondary cylinders.

13. The load equalizing arrangement according to claim 12, wherein said second shoulder is a radially extending surface between each said primary piston and the corresponding rod means.

14. The load equalizing arrangement according to claim 13, wherein said means for directing hydraulic fluid under pressure includes fluid pressure responsive accumulator means in fluid flow communication with said secondary cylinders, and fluid pressure responsive overload relief means in fluid flow communication with said primary cylinders.

15. The load equalizing arrangement according to claim 10, wherein each said secondary cylinder is provided in said tool support means axially inwardly of the corresponding primary cylinder, each said rod means having head means thereon providing said second shoulder engaging said corresponding secondary piston.

16. The load equalizing arrangement according to claim 15, wherein said means for directing hydraulic fluid under pressure includes fluid pressure responsive accumulator means in fluid flow communication with said secondary cylinders, and fluid pressure responsive overload relief means in fluid flow communication with said primary cylinders.

17. The load equalizing arrangement according to claim 8, wherein said biasing means is spring means.

18. The load equalizing arrangement according to claim 17, wherein each said primary piston includes a rod extending through the inner end of the corresponding primary cylinder, means on said rod and tool support means providing axially opposed shoulders, said spring means engaging between said shoulders to bias the corresponding primary piston in the direction inwardly of the corresponding primary cylinder.

19. The load equalizing arrangement according to claim 18, wherein said means on said rod is a collar slidably received thereon and head means engaging said collar in the direction toward the corresponding primary piston, and means on said tool support means providing a shoulder engaged by said collar in the direction away from the corresponding primary piston.

20. The load equalizing arrangement according to claim 19, and fluid pressure responsive overload relief means in fluid flow communication with said primary cylinders.

* * * * *

Disclaimer 4,272,980.—*Louis F. Carrieri,* La Grange Part, IL. LOAD EQUALIZER FOR PRESS TOOLING. Patent dated June 16, 1981. Disclaimer filed July 6, 1981, by the assignee, *Gulf & Western Manufacturing Co.*

Hereby enters this disclaimer to claims 1, 3, 8 and 17 of said patent.

[*Official Gazette October 13, 1981.*]